United States Patent [19]

Yu

[11] 4,357,290

[45] Nov. 2, 1982

[54] SPLITTABLE CONJUGATE YARN

[75] Inventor: Jing-peir Yu, Pensacola, Fla.

[73] Assignee: Monsanto Company, St. Louis, Mo.

[21] Appl. No.: 186,879

[22] Filed: Sep. 12, 1980

Related U.S. Application Data

[62] Division of Ser. No. 108,428, Dec. 31, 1979.

[51] Int. Cl.[3] ..... B27H 7/18

[52] U.S. Cl. ..... 264/147; 264/171

[58] Field of Search ..... 264/177 F, 171, 147; 428/374

[56] References Cited

U.S. PATENT DOCUMENTS

| | | | |
|---|---|---|---|
| 3,540,080 | 11/1970 | Goossens | 264/171 |
| 3,725,192 | 4/1973 | Ando et al. | 264/171 |
| 3,802,177 | 4/1974 | Sekigudin et al. | 264/171 |
| 4,051,287 | 9/1977 | Hayashi et al. | 264/171 |
| 4,246,219 | 1/1981 | Yu et al. | 264/177 F |

FOREIGN PATENT DOCUMENTS

| | | | |
|---|---|---|---|
| 162131 | 6/1933 | Switzerland | 264/177 F |

*Primary Examiner*—Jay H. Woo

*Attorney, Agent, or Firm*—Kelly O. Corley

[57] ABSTRACT

A multi-filament splittable conjugate yarn wherein the filaments have the same denier and are splittable into different numbers of sub-filaments.

2 Claims, 2 Drawing Figures

SPLITTABLE CONJUGATE YARN

This is a division, of application Ser. No. 108,428 filed Dec. 31, 1979.

The invention relates to the art of spinning conjugate filaments splittable into sub-filaments having different deniers. More particularly, it relates to control of the properties of the sub-filaments.

A more natural hand in fabrics made from melt spun yarns is attained when the yarns are composed of filaments having different deniers. A simple known method of making yarns of mixed dpf (denier per filament) is to spin a polymer through a spinneret having capillaries of various lengths and/or cross-sectional areas. To spin a yarn from such a spinneret presents processing difficulties because of the effect of transverse quenching air on the resulting molten streams having different surface areas presented to the quenching air. Large molten streams will be blown further away from the quench air source than small ones. One must accordingly design and install the spinneret such that the small streams are nearest the quench air source, to avoid having the large streams be blown into the small streams. Furthermore, in such a process the quenching rates and the stresses on the large and small streams are different, causing morphological differences in the resulting filaments. Such differences cause variable dyeability and other problems.

According to the invention, these and other difficulties are avoided as will be set forth below.

According to a first aspect of the invention, there is provided a spinning process, comprising generating a plurality of molten streams from a spinneret, the streams being formed from axially extending continuous segments of dissimilar polymers arranged alternately in side-by-side temporarily adhering relationship; quenching the streams to form filaments; and withdrawing the filaments from the streams, the streams being selected such that first and second of the filaments have substantially the same denier and are splittable into different numbers of sub-filaments.

According to another aspect of the invention, the streams from which the first and the second of the filaments are quenched have substantially the same jet stretch.

According to another aspect of the invention, there is provided a multi-filament yarn comprising a plurality of filaments of equal deniers splittable into sub-filaments of at least first and second polymers, at least one of the sub-filaments of the first polymer aplit from a first of the filaments having a different denier than another of the sub-filaments of the first polymer split from a second of the filaments.

According to another aspect of the invention, the first and the second of the filaments are splittable into different numbers of sub-filaments.

Figure 1:
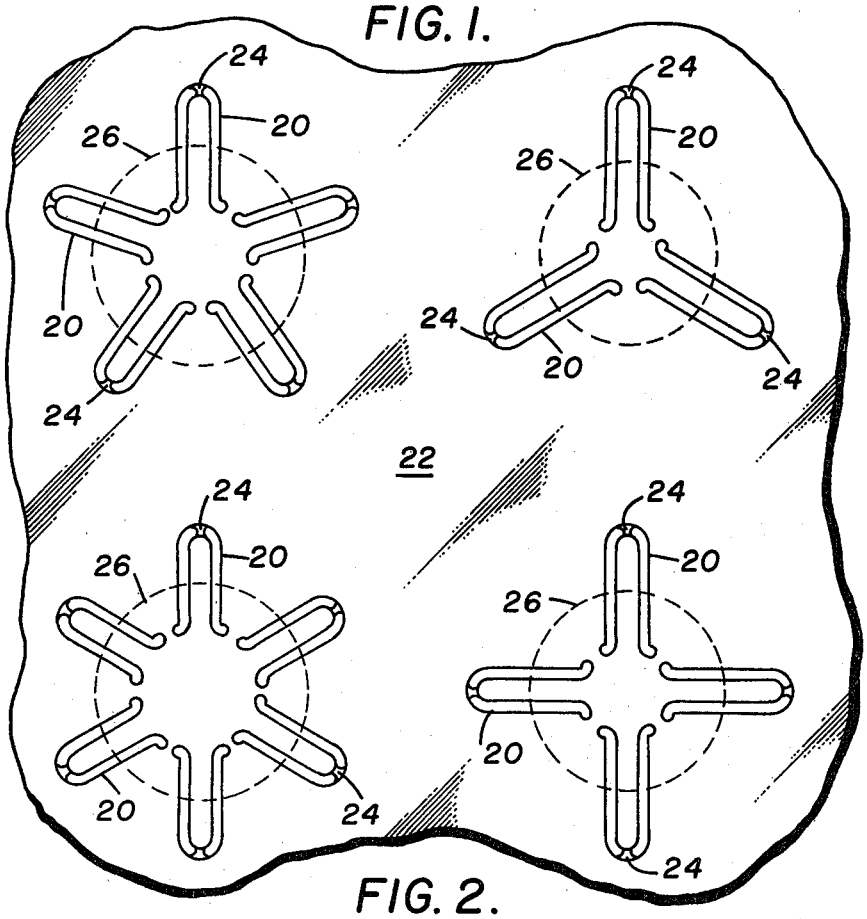
Figure 2:
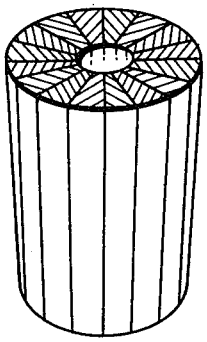

Other aspects will in part appear hereinafter and will in part be obvious from the following detailed description taken in connection with the accompanying drawing, wherein:

FIG. 1 is a bottom plan view of a spinneret for making yarns according to the invention; and FIG. 2 is a fragmentary perspective view of an exemplary filament according to the invention.

As shown in FIG. 1, the preferred spinneret construction illustrated includes several groups of generally arched or horseshoe-shaped slots 20 in spinneret blank 22, those slots 20 in each group being arranged symmetrically about a central point for that group with the open end of the horseshoe shapes facing inwardly. The several slots 20 in each group constitute a combined orifice for spinning a single filament. Slots 20 extend entirely through blank 22 except for recessed web 24 at the apex of each slot 20, the webs 24 and the lands between adjacent ends of slots 20 providing support to retain the material in the center of the combined orifice.

The two dissimilar polymers are fed to the combined orifices as sheath-core supply streams, with dotted circles 26 representing the interfaces between the two polymers. Adjacent ends of adjacent slots 20 are sufficiently close that the streams issuing therefrom unite just below the spinneret. The molten spun streams are thus hollow structures composed of alternating axially extending segments of the two polymers. Surface tension and other effects tend to make the molten streams approach hollow circular cross-sections prior to solidification, as shown in FIG. 2, which illustrates a filament formed by a combined orifice composed of eight slots 20. It the polymers differ in melt viscosity, it is ordinarily preferable to provide the polymer having the lower viscosity as the core of the stream approaching each combined orifice.

The various slot dimensions in the directions parallel to and transverse to the direction of polymer flow are selected to control the relative deniers of the combined filaments spun from the various combined orifices. Most conveniently, the various slots may be identical in their transverse dimensions, with their lengths parallel to the direction of polymer flow selected to control the relative combined filament deniers. Thus, the three slots 20 for the combined orifice in the upper right corner of FIG. 1 may be made shorter in the direction parallel to polymer flow than the six slots 20 for the combined orifice in the lower left corner of FIG. 1, so that the combined filaments spun therefrom have substantially the same denier. The molten streams will thus have substantially the same quenching rate and be subjected to substantially the same stresses during spinning, so that the resulting sub-filaments of the same polymer type will dye substantially the same although they may be of substantially different deniers.

Exemplary dissimilar polymers are poly (ethylene terephthalate) and nylon 66. By "dissimilar" is meant that the polymeric components in the solidified filaments can be readily separated from one another into sub-filaments.

The hand of fabrics made from yarns according to the invention can be varied widely by selection of substantially different deniers for the sub-filaments. Marked improvement in hand occurs when some sub-filaments have deniers at least 50% larger than others of the sub-filaments, with better results when the difference is at least 100%.

Yarns according to the invention can be produced by spinning followed by drawing, either in a coupled process or as separate operations, or can be produced by spinning at speeds sufficiently high as to eliminate the need for a drawing operation.

What is claimed is:

1. A spinning process, comprising:

a. generating a plurality of molten streams from a spinneret, said streams being formed from axially extending continuous segments of dissimilar polymers arranged alternately in side-by-side temporarily adhering relationship;

b. quenching said streams to form filaments; and c. withdrawing said filaments from said streams, said streams being selected such that first and second of said filaments have substantially the same denier and are splittable into different numbers of subfilaments.

2. The process defined in claim 1, wherein said streams from which said first and said second of said filaments are quenched have substantially the same jet stretch.

* * * * *